US010744366B1

(12) United States Patent
Sorin et al.

(10) Patent No.: US 10,744,366 B1
(45) Date of Patent: Aug. 18, 2020

(54) COLLAPSIBLE WEIGHTLIFTING BAR AND METHODS OF MANUFACTURE AND USE

(71) Applicants: Albert Sorin, Lexington, SC (US); Richard Sorin, Lexington, SC (US)

(72) Inventors: Albert Sorin, Lexington, SC (US); Richard Sorin, Lexington, SC (US)

( * ) Notice: Subject to any disclaimer, the term of this patent is extended or adjusted under 35 U.S.C. 154(b) by 0 days.

(21) Appl. No.: 15/016,536

(22) Filed: Feb. 5, 2016

Related U.S. Application Data

(60) Provisional application No. 62/112,268, filed on Feb. 5, 2015.

(51) Int. Cl.
*A63B 21/072* (2006.01)
*A63B 21/00* (2006.01)
*A63B 23/12* (2006.01)

(52) U.S. Cl.
CPC ..... *A63B 21/0724* (2013.01); *A63B 21/4035* (2015.10); *A63B 23/12* (2013.01); *A63B 2210/50* (2013.01)

(58) Field of Classification Search
CPC ..... A63B 21/072–075; A63B 21/4035; A63B 23/12; A63B 2210/50; A63B 21/0724
See application file for complete search history.

(56) References Cited

U.S. PATENT DOCUMENTS 3,231,270 A * 1/1966 Winer ..... A63B 21/0602 482/106
3,781,007 A * 12/1973 Baker ..... A63B 21/0602 482/108
4,618,143 A * 10/1986 Twardosz ..... A63B 21/0724 482/106
4,690,400 A * 9/1987 Metz ..... A63B 21/015 482/106
5,588,942 A * 12/1996 Dillard ..... A63B 21/4035 482/106
6,758,795 B2 * 7/2004 Barber ..... A63B 21/072 482/106
8,672,815 B1 * 3/2014 Springer ..... A63B 21/0724 482/106
9,050,495 B2 * 6/2015 Sieben ..... A63B 71/0036
10,493,313 B2 * 12/2019 Jones ..... A63B 71/0036
2004/0242385 A1 * 12/2004 Emick ..... A63B 21/0724 482/106
2006/0110716 A1 * 5/2006 Micari ..... A63B 69/18 434/253
2006/0116258 A1 * 6/2006 Shifferaw ..... A63B 21/0088 482/111

(Continued)

OTHER PUBLICATIONS

Website: https://www.garage-gyms.com/powerlifting-barbell-vs-olympic/ published: Dec. 3, 2013 retrieved: Nov. 20, 2018 (Year: 2013).*

(Continued)

*Primary Examiner* — Megan Anderson
(74) *Attorney, Agent, or Firm* — Nexsen Pruet LLC; Todd A. Serbin

(57) ABSTRACT

A collapsible weightlifting bar, comprising: two halves bisected from a weightlifting bar; a hollow, tubular splint; and, removably attachable hardware to secure the two halves to the splint. The weightlifting bar is configured to be adjustable in overall length and is configured to be collapsible for more efficient storage and transport.

11 Claims, 6 Drawing Sheets

(56) References Cited

U.S. PATENT DOCUMENTS

| | | | | |
|---|---|---|---|---|
| 2008/0096737 | A1* | 4/2008 | Ayoub | A63B 21/0724 482/107 |
| 2014/0018213 | A1* | 1/2014 | Chen | A63B 21/0724 482/106 |
| 2015/0038302 | A1* | 2/2015 | O'Brien | A63B 21/0724 482/107 |
| 2016/0047405 | A1* | 2/2016 | Curley | A63B 15/00 482/139 |

OTHER PUBLICATIONS

Webpage from http://www.sportsauthority.com/products/marcy-7-3-piece-olympic-bar-p3889302; pp. 1-4; Mar. 9, 2016.
Webpage from http://www.walmart.com/ip/Golds-s-Gym-110-lb-Olympic-Weight-Set/21672525; pp. 1-6; Mar. 9, 2016.

* cited by examiner

COLLAPSIBLE WEIGHTLIFTING BAR AND METHODS OF MANUFACTURE AND USE

PRIORITY CLAIM

The present application claims priority to U.S. Provisional Patent No. 62/112,268 filed Feb. 5, 2015, which is incorporated herein by reference.

FIELD AND BACKGROUND OF THE INVENTION

The present invention, in some embodiments thereof, relates to a weightlifting apparatus and, more particularly, but not exclusively, to a weightlifting bar.

Previous attempts have been made to provide weightlifting bars, for example the Gold's Gym® 110-lb Olympic Barbell Weight Set available on the Amazon® online retail website and on the Walmart® online retail website, and the Marcy® 7' Olympic Three Piece Bar available on the Target® online retail website.

SUMMARY OF THE INVENTION

There is provided in accordance with an exemplary embodiment of the invention, a method of manufacturing a collapsible weightlifting bar, comprising: bisecting a pre-manufactured, conventional weightlifting bar, creating two bar halves; drilling at least one hole near an inward end of each bar half, the hole being configured for passage therethrough of a screw or other removably attachable hardware; and, providing a hollow, tubular splint including at least one hole corresponding to the at least one hole in each bar half, where the inward end of each bar half is removably insertable into opposing ends of the splint.

In an embodiment of the invention, the method further comprises removably inserting the inward end of each bar half into opposite ends of a splint.

In an embodiment of the invention, the method further comprises reversibly securing each bar half to the splint using at least one screw, or other removably attachable hardware, screwed into a bar half hole and a corresponding splint hole.

In an embodiment of the invention, the splint is configured with at least as many corresponding screw holes as the total number of screw holes drilled along a longitudinal axis each bar half.

In an embodiment of the invention, the method further comprises comprising dissembling the assembled collapsible weightlifting bar for transport by removing the removably attachable hardware, thereby un-securing the bar halves from the splint, and removing the bar halves from the splint.

There is further provided in accordance with an exemplary embodiment of the invention, a collapsible weightlifting bar, comprising: two halves bisected from a pre-manufactured, conventional weightlifting bar, each half including at least one hole near an inward end of each bar half; a hollow, tubular splint including at least one hole corresponding to the at least one hole in each bar half and configured for receipt of the inward ends of the two halves therein; and, removably attachable hardware to secure the two halves to the splint.

In an embodiment of the invention, the removably attachable hardware includes at least one of a screw, spring pin, dowel, detent pin and machine latch.

In an embodiment of the invention, an outward end of each bar half, located on the opposite end of the bar half as the inward end, is configured for placement of exercise weights thereon.

In an embodiment of the invention, at least one component of the collapsible weightlifting bar is constructed of steel.

In an embodiment of the invention, the bar is configured to be adjustable in length by providing at least one of the splint and each bar half with more than one hole such that the holes that correspond between the splint and each bar half are adjustable.

There is further provided in accordance with an exemplary embodiment of the invention, a method of using a collapsible weightlifting bar, comprising: inserting an inward end of a first bar half into a splint; aligning at least one screw hole in the inward end of the first bar half with at least one corresponding screw hole in the splint; removably securing the first bar half to the splint using removably attachable hardware; inserting an inward end of a second bar half into the splint; aligning at least one screw hole in the inward end of the second bar half with at least one corresponding screw hole in the splint; removably securing the second bar half to the splint using removably attachable hardware; and, commencing exercise after at least one weight has been placed on an outward end of at least one of the halves.

In an embodiment of the invention, aligning the at least one screw hole in the inward end of a bar half with at least one corresponding screw hole in the splint changes the correspondence of the respective holes to adjust the overall length of the collapsible weightlifting bar.

In an embodiment of the invention, securing includes threading at least one screw through the corresponding at least one screw hole in the bar half and the at least one corresponding screw hole in the splint.

In an embodiment of the invention, the method further comprises dissembling the assembled collapsible weightlifting bar after exercise by removing the removably attachable hardware, thereby un-securing the bar halves from the splint, and removing the bar halves from the splint.

In an embodiment of the invention, the method further comprises adding at least one weight to an outward end of at least one of the halves for exercise.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example, are not necessarily to scale, and are for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
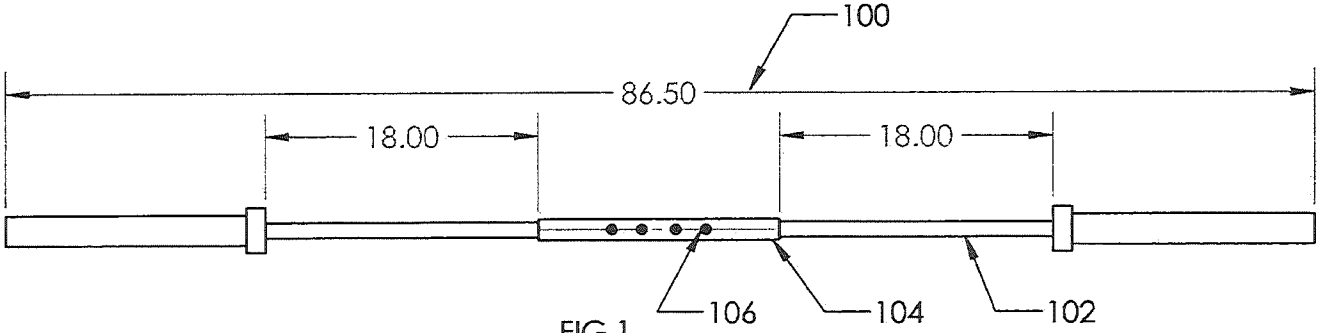
FIG. 1 is a top view of a collapsible weightlifting bar, in accordance with an exemplary embodiment of the invention.

The present invention, in some embodiments thereof, relates to a weightlifting apparatus and, more particularly, but not exclusively, to a weightlifting bar.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways. It should also be understood that physical dimensions shown in any Figures are by way of example only.

Referring now to the drawings, FIG. 1 is a top view of a collapsible weightlifting bar 100, in accordance with an exemplary embodiment of the invention. In an embodiment of the invention, two separate bar halves 102 (each a bar half 102) are removably attached to each other using a hollow, tubular splint 104. In some embodiments of the invention, removably attachable hardware like screws 106 are used to secure inward ends 202 of the bar halves 102 inside the splint 104, as shown and described in more detail with respect to FIG. 2.

Additionally, alternatively and/or optionally, hardware for making the bar halves removably attachable includes at least one spring pin, dowel, detent pin and/or machine latch is used to connect the bar halves 102 to the splint 104.

In some embodiments of the invention, the overall weightlifting bar 100 length is 86.50 in. In some embodiments of the invention, at least one component of the bar 100 is constructed of steel, for example stainless steel. In some embodiments of the invention, at least one screw is stainless steel grade 316. In some embodiments of the invention, the splint 104 is stainless steel grade 304.

In an embodiment of the invention, at least the bar halves 102 and the splint 104 are sold as a kit. Optionally, weights and/or weight clips and/or at least one tool and/or at least one screw 106 are also included in the kit.

Figure 2:
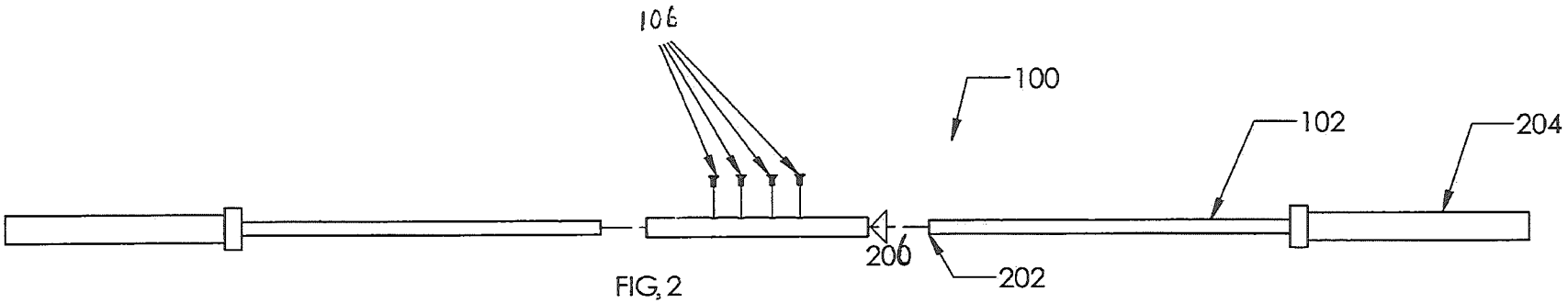
FIG. 2 is an exploded view of a collapsible weightlifting bar, in accordance with an exemplary embodiment of the invention.

FIG. 2 is an exploded side view of the collapsible weightlifting bar 100, in accordance with an exemplary embodiment of the invention. The inward end 202 of the bar half 102 is inserted 206 into the splint 104 and is secured to the splint 104 by at least one screw 106, in an embodiment of the invention. The outward ends 204 of the weightlifting bar 100 are where weight lifting plates are positioned for exercise. In some embodiments of the invention, holes in at least one bar half 102 are adjustably placed in relation to holes in the splint 104 in order to change the overall length of the bar 100, such that when the bar half 102 is secured to the splint 104, the holes in the half 102 are not always secured to the same corresponding holes in the splint 104.

Figure 3A:
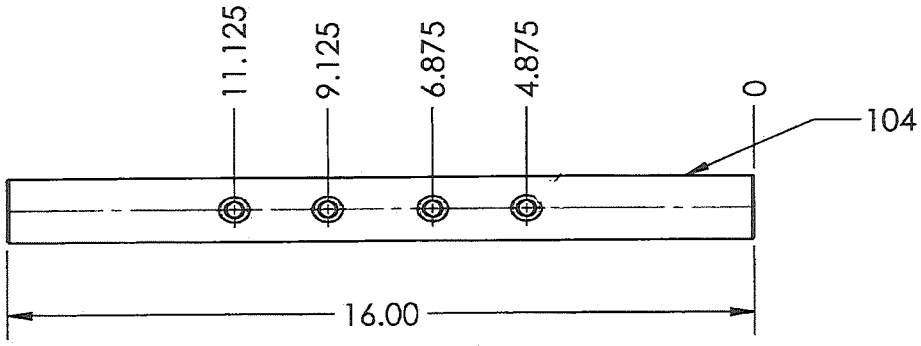
FIG. 3A is a top view of a splint, in accordance with an exemplary embodiment of the invention.

FIG. 3A is a top view of the splint 104, in accordance with an exemplary embodiment of the invention. The splint 104 is configured with at least one screw hole 302 for passage therethrough of a screw 106, which removably secures the inward end 202 of the bar half 102 to the splint. In the configuration depicted, there are four screw holes 302 whereby two screws 106 are used to secure each bar half 102 to the splint 104 and thus, to each other to form a full length weightlifting bar 100. It should be understood that more or less screws, or screw equivalents, could be used to removably attach the bar halves 102 to the splint 104 (the corollary being that the splint 14 could have more or less than 4 total screw holes 302 and/or each bar half 102 could have more or less than 2 total screw holes). In some embodiments of the invention, the splint 104 is 16 in. in length. In some embodiments of the invention, the splint 104 is slightly larger in circumference than the circumference of the weightlifting bar 100. Optionally, the outer surface of the splint 104 is 1.39 in. in circumference and the inner surface (the surface which abuts the bar halves 102) is 1.12 in. in circumference, as shown in FIG. 3C which is a view down a longitudinal axis of the splint 104, in accordance with an exemplary embodiment of the invention. It should be noted that dimensions shown in the figures are by way of example only.

Figure 3B:
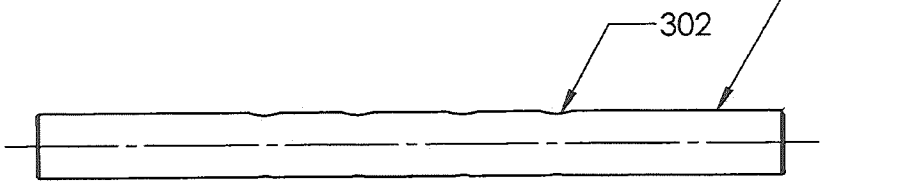
FIG. 3B is a side view of a splint, in accordance with an exemplary embodiment of the invention.
Figure 3C:
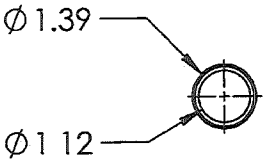
FIG. 3C is a view down a longitudinal axis of a splint, in accordance with an exemplary embodiment of the invention.

FIG. 3B is a side view of the splint 104, in accordance with an exemplary embodiment of the invention which shows the screw holes 302. In some embodiments of the invention, the screws 106 go all the way through the splint 104 and thus pass entirely through the end 202 of the bar half 102. In some embodiments of the invention, the screws 106 pass only through one side of the splint 104 and/or the bar half 102.

Figure 4:
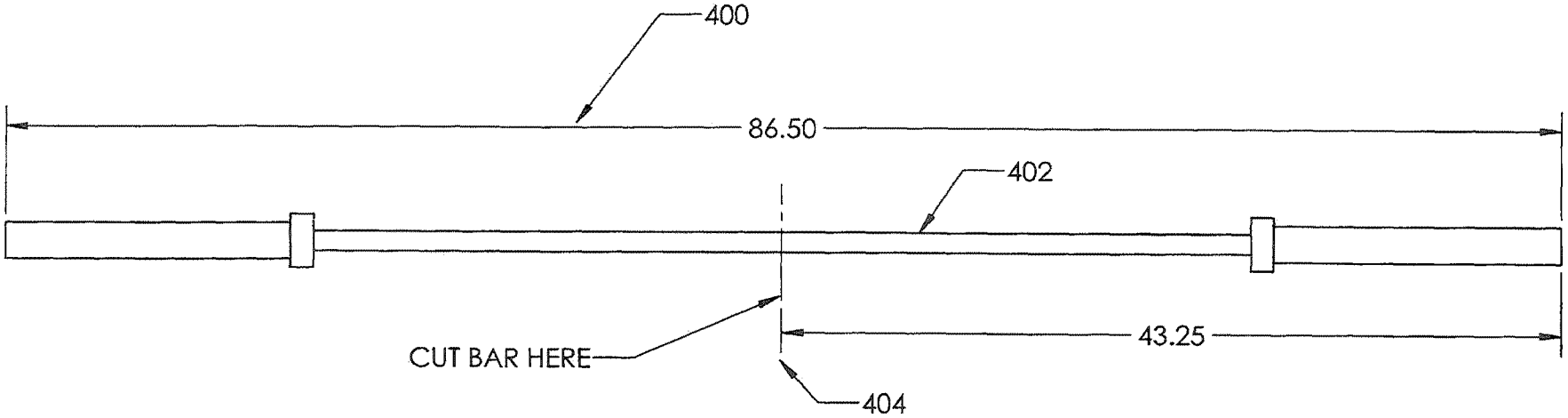
FIG. 4 is a view of a pre-manufacture weightlifting bar before being made into a collapsible bar, in accordance with an exemplary embodiment of the invention.

FIG. 4 is a view of a pre-manufactured weightlifting bar 400 before being made into a collapsible bar 100, in accordance with an exemplary embodiment of the invention. The pre-manufactured bar 400 would otherwise be usable for any weightlifting activity using a conventional weightlifting bar and in and of itself represents a finished commercial product. An exemplary conventional, pre-manufactured bar 400 includes the Sorinex® Performance Bar, product code P01501, available from Sorinex Exercise Equipment, Inc. However, in an embodiment of the invention, the conventional, finished-product weightlifting bar 400 is cut in the middle 404 to separate the bar 400 into equal halves 402.

Figure 5:
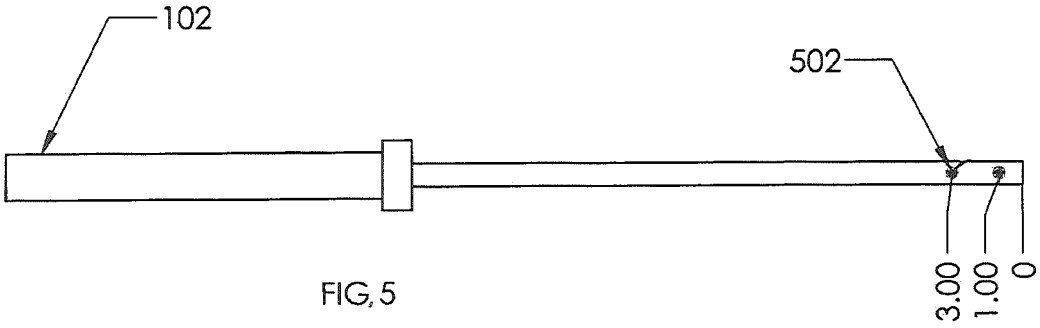
FIG. 5 is a view of a portion of a post-manufacture collapsible weightlifting bar, in accordance with an exemplary embodiment of the invention.

FIG. 5 is a view of the bar half 102 of a post-manufacture collapsible weightlifting bar 100 configured with at least one hole 502 for passage of a screw 106 therethrough, in accordance with an exemplary embodiment of the invention.

Figure 6:
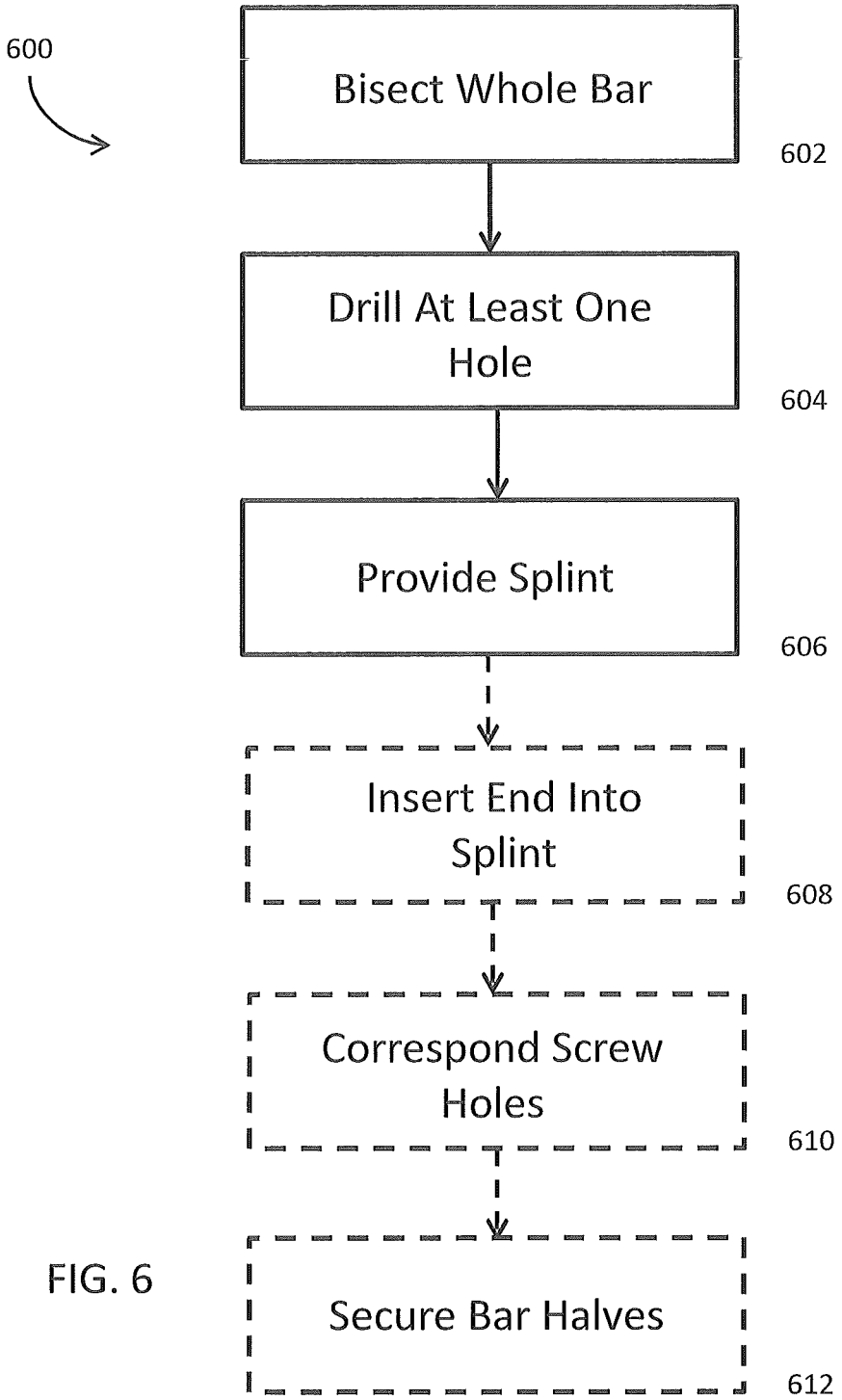
FIG. 6 is a flowchart depicting a method of manufacturing a collapsible weightlifting bar, in accordance with an exemplary embodiment of the invention; and, FIG. 7 is a flowchart depicting a method of using a collapsible weightlifting bar, in accordance with an exemplary embodiment of the invention.

FIG. 6 is a flowchart 600 depicting a method of manufacturing a collapsible weightlifting bar, in accordance with an exemplary embodiment of the invention. In an embodiment of the invention, a conventional, pre-manufactured (otherwise commercially saleable) weightlifting bar 400 is bisected (602). Optionally, the bar 400 is bisected (602) into two equal halves. At least one hole is drilled (604) into each half 102 of the bar 400, the hole being configured for passage therethrough of a screw or other removably attachable hardware, in an embodiment of the invention. A hollow, tubular splint 104 is provided (606) to the bisected halves. Optionally during manufacture, the inward end 202 of each half 102 of the weightlifting bar is removably inserted (608) into opposite ends of the splint 104, the splint 104 being configured with at least enough screw holes to correspond to at least one hole of each of the halves 102. At least one hole in each bar half is corresponded (610) with at least one hole in the splint 104 in preparation for securing (612) the bar halves together and to the splint, using the splint. In some embodiments of the invention, the splint 104 is configured with more holes along the longitudinal axis of the splint 104 than are actually used, for example to make the overall length of the assembled bar adjustable. Additionally, alternatively and/or optionally, the bar halves 102 are configured with more holes along the longitudinal axis of the bar than are actually used, for example to make the overall length of the assembled bar adjustable. Optionally, screws or other equivalent removably attachable hardware are used to reversibly secure (612) the bar halves 102 within the splint 104. In some embodiments of the invention, manufacture ends with providing (606) wherein the disassembled bar is shipped and/or sold.

Figure 7:
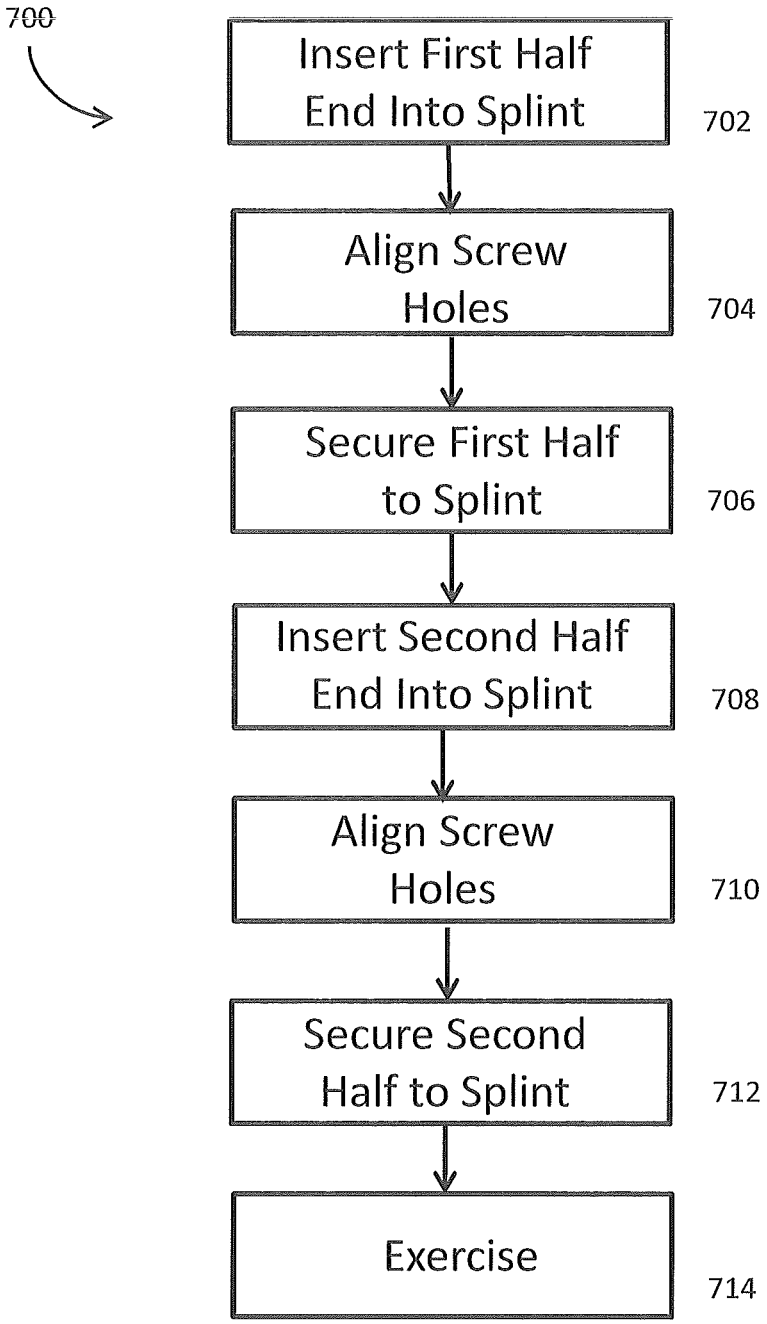

FIG. 7 is a flowchart 700 depicting a method of using a collapsible weightlifting bar 100, in accordance with an exemplary embodiment of the invention. In an embodiment of the invention, the inward end 202 of a first bar half 102 is inserted (702) into the splint 104. In an embodiment of the invention, at least one screw hole in the bar half 102 is aligned (704) with at least one corresponding screw hole in the splint 104, such that at least one more set of corresponding holes is left available for the second bar half 102. The splint 104 and the first bar half 102 are removably secured (706) to each other by threading a screw through the aligned screw holes in each part. Optionally, a plurality of screws are used to secure (706) the first bar half to the splint 104, by aligning (704) multiple screw hole pairs. In an embodiment of the invention, the second bar half 102 is inserted (708) into the splint 104 and at least one of the remaining screw holes of the splint 104 is aligned (710) with at least one screw hole of the second half 104. The second half 102 is secured (712) to the splint 104 by threading a screw through the at least one aligned pair of screw holes. Optionally, both halves 102 are inserted (702), (708) into the splint 104 before securing (706), (712), instead of securing one half at a time.

In an embodiment of the invention, weights are placed on the outward facing ends 204 of the bar 100 for the user to commence (714) exercise. Break-down or disassembly of the bar 100 is performed by reversing the assembly procedure, in an embodiment of the invention.

In an embodiment of the invention, disassembly is achieved by reversing the order of the recited steps.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A collapsible weightlifting bar, comprising:

a first bar half and a second bar half of a weightlifting bar, each of the first and second halves including at least one hole near an inward end of each of the first and second halves where an outward end of each of the first and second bar halves, located on an opposite end of the bar half of the inward end, is cylindrically-shaped and sized for placement of standard weight lifting plates therearound;

a splint, of a shorter length than the first and second bar halves and wherein the splint is rigid, hollow, and tubular, including three or more holes on the splint and configured for receipt of the inward ends of the first and second bar halves therein, where the weightlifting bar is configured to be adjustable in overall length by corresponding the at least one hole of each of the first and second bar halves to the at least one hole on each side of the splint, and wherein the correspondence between the respective holes of the splint and each of the first and second bar halves is adjustable by sliding the first and second bar halves within the splint; and, removably attachable hardware to secure the first and second bar halves to the splint.

2. The collapsible weightlifting bar of claim 1, where the removably attachable hardware is selected from the group consisting essentially of at least one screw, spring pin, dowel, detent pin and machine latch.

3. The collapsible weightlifting bar of claim 1, where at least one of the first and second bar halves of the collapsible weightlifting bar is constructed of steel.

4. The collapsible weightlifting bar of claim 1, wherein the overall length of the weightlifting bar is 86.50 inches.

5. The collapsible weightlifting bar of claim 1, wherein the splint is 16 inches in length.

6. The collapsible weightlifting bar of claim 1, wherein an inner surface of the splint is 1.12 inches in circumference.

7. A method of using a collapsible weightlifting bar, comprising:

inserting an inward end of a first bar half into a first side of a splint, of a shorter length than the first and second bar halves and wherein the splint is rigid, hollow, and tubular, and including at least three or more holes on the splint, where an outward end of the first bar half is located on an opposite end of the first bar half as the inward end, wherein the outward end is cylindrically-shaped and sized for placement of at least one weight lifting plate therearound;

aligning at least one screw hole in the inward end of the first bar half with at least one screw hole in the first side of the splint so that the at least one screw hole in the first bar half corresponds to the at least one screw hole in the splint;

removably securing the first bar half to the splint using removably attachable hardware;

inserting an inward end of a second bar half into a second side of the splint, where an outward end of the second bar half is located on an opposite end of the second bar half as the inward end, wherein the outward end is cylindrically-shaped and sized for placement of the at least one weight lifting plate therearound;

aligning at least one screw hole in the inward end of the second bar half with at least one corresponding screw hole in the second side of the splint;

removably securing the second bar half to the splint using removably attachable hardware;

wherein the weightlifting bar is configured to be adjustable in overall length by by sliding the first and second bar halves within the splint prior to removably securing the first and second bar halves; and, commencing exercise.

8. The method according to claim 7, where aligning the at least one screw hole in the inward end of the first or second bar half with at least one corresponding screw hole of the at least three or more holes in the splint changes the correspondence of the respective holes to adjust an overall length of the collapsible weightlifting bar.

9. The method according to claim 7, where securing using the removably attachable hardware includes threading at least one screw through the corresponding at least one screw hole in each of the first and second bar halves and the at least one corresponding screw hole in the splint.

10. The method according to claim 7, further comprising dissembling the assembled collapsible weightlifting bar after exercise by removing the removably attachable hardware, thereby un-securing the first and second bar halves from the splint, and removing the first and second bar halves from the splint.

11. The method according to claim 7, further comprising adding the at least one weight lifting plate to the outward end of at least one of the first and second bar halves for exercise.

* * * * *